US009049925B1

(12) United States Patent
Winchester

(10) Patent No.: US 9,049,925 B1
(45) Date of Patent: Jun. 9, 2015

(54) TOOL MOUNTING STRUCTURE

(71) Applicant: Russell L. Winchester, Red Bluff, CA (US)

(72) Inventor: Russell L. Winchester, Red Bluff, CA (US)

( * ) Notice: Subject to any disclaimer, the term of this patent is extended or adjusted under 35 U.S.C. 154(b) by 178 days.

(21) Appl. No.: 13/694,892

(22) Filed: Jan. 14, 2013

(51) Int. Cl.
*A47B 91/00* (2006.01)
*A47B 11/00* (2006.01)

(52) U.S. Cl.
CPC ..... *A47B 11/00* (2013.01)

(58) Field of Classification Search
USPC ..... 248/349.1, 346.01, 430, 415, 425, 248/125.7
See application file for complete search history.

(56) References Cited

U.S. PATENT DOCUMENTS 2,386,266 A * 10/1945 Robertson et al. ..... 248/124.1
3,572,861 A * 3/1971 Rogers et al. ..... 384/617
3,637,185 A * 1/1972 Mikos et al. ..... 248/425
3,653,340 A * 4/1972 Bugg ..... 108/139
3,760,745 A * 9/1973 MacManus ..... 108/139
3,762,275 A * 10/1973 Imamura ..... 409/219
4,401,287 A * 8/1983 Moeser ..... 248/425
4,473,206 A * 9/1984 Stillinger ..... 248/371
4,487,389 A * 12/1984 Ziegler ..... 248/282.1
4,687,167 A * 8/1987 Skalka et al. ..... 248/126
5,163,651 A * 11/1992 Matsumoto ..... 248/425
5,299,656 A * 4/1994 Grill ..... 182/186.4
5,398,740 A * 3/1995 Miller ..... 144/286.1
5,425,523 A * 6/1995 Madey et al. ..... 248/466
5,535,684 A * 7/1996 John ..... 108/50.02
5,647,420 A * 7/1997 Michell ..... 144/286.1
5,682,934 A * 11/1997 Rybski ..... 144/144.51
5,765,796 A * 6/1998 Lanus ..... 248/349.1
5,782,451 A * 7/1998 Carnahan et al. ..... 248/425
5,884,681 A * 3/1999 Nickles ..... 144/329
6,154,956 A * 12/2000 Frohardt ..... 29/825
6,179,116 B1 * 1/2001 Noniewicz et al. ..... 198/632
6,193,044 B1 * 2/2001 Larsen ..... 193/35 R
6,357,705 B1 * 3/2002 Hackett ..... 248/163.2
6,463,946 B1 * 10/2002 Wu ..... 135/16
6,681,704 B1 * 1/2004 Brookhiser ..... 108/115
6,843,402 B2 * 1/2005 Sims et al. ..... 227/148
6,868,794 B2 * 3/2005 Bullock et al. ..... 108/94
6,942,085 B1 * 9/2005 Tatz ..... 193/35 R
7,370,747 B2 * 5/2008 Ruiz ..... 193/35 R
7,677,283 B2 * 3/2010 Hooker ..... 144/286.5
8,382,086 B2 * 2/2013 Bresette ..... 269/289 R
2010/0008661 A1 * 1/2010 Wood ..... 396/428
2010/0065705 A1 * 3/2010 Brown et al. ..... 248/288.11
2011/0036275 A1 * 2/2011 Covarrubio ..... 108/42
2012/0043446 A1 * 2/2012 Britton et al. ..... 248/349.1
2012/0068035 A1 * 3/2012 Iguchi ..... 248/346.01

* cited by examiner

*Primary Examiner* — Monica Millner

(57) ABSTRACT

The tool mounting structure includes a base plate for mounting on a supporting structure, such as a workbench. On top of the base plate is a thrust bearing and on top of the thrust bearing is a top plate upon which shop tools can be mounted. Any one of the shop tools can be rotated to an accessible position for use. A lock releasibly locks the top plate and the tools mounted thereon in the selected rotary position.

4 Claims, 5 Drawing Sheets

TOOL MOUNTING STRUCTURE

BACKGROUND

In most workshops, the artisan requires access to various types, styles, and sizes of small power tools and clamping devices such as vices. Traditionally, a workshop table has been used to mount such devices. They are arranged along the length of the table so that the artisan moves laterally from station to station in front of the successive tools, as the project requires. Such a mounting system requires significant length of the workbench so that each power tool and non-power tool mounted thereon has sufficient space for access. In smaller shops, this is inconvenient. There is need for a structure by which the artisan's tools can be mounted and yet made available as required for the artisan's work.

BRIEF SUMMARY OF THE INVENTION

In order to aid in the understanding of this invention it can be stated in essentially summary form that it is directed to a tool mounting structure which can be attached to a workbench. The tool mounting structure has a top plate upon which one or more non-powered or powered workshop tools can be mounted. A base plate is configured for attaching to a supporting device such as a workbench or wall bracket. A vertical axis bearing therebetween is attached to the baseplate and the top plate so that the top plate is rotatable on a vertical axis. The top plate may be round, rectangular, or specially configured to receive a plurality of powered and non-powered tools for attachment thereto. Rotation of the top plate brings a selected one of these tools forward for access by the artisan. The top plate has structure thereon so that it may be locked in place in the selected position.

It is thus a purpose and advantage of this invention to provide a top plate which is mounted on a rotary bearing wherein the top plate is configured to carry thereon a plurality of selected workshop tools, either powered or non-powered, so that the top plate can be rotated to bring a selected tool forward for access by the artisan.

It is another purpose and advantage of this invention to provide a structure wherein a plurality of workshop tools can be mounted upon the top plate and the top plate can be rotated on a vertical axis to bring the selected tool to the forward, accessible position and the top plate locked in that position for the artisan's utilization of that selected tool.

It is another purpose and advantage of this invention to provide a tool mounting structure which can be mounted upon a workbench or can be mounted upon a wall bracket so that the tool mounting structure is positioned so that any one of the tools mounted thereon can be rotated to a forward position and locked in place.

Other purposes and advantages of this invention will be apparent from a study of the following portion of the specification, the claims and the attached, drawings.

DESCRIPTION OF THE PREFERRED EMBODIMENTS

Figure 1:
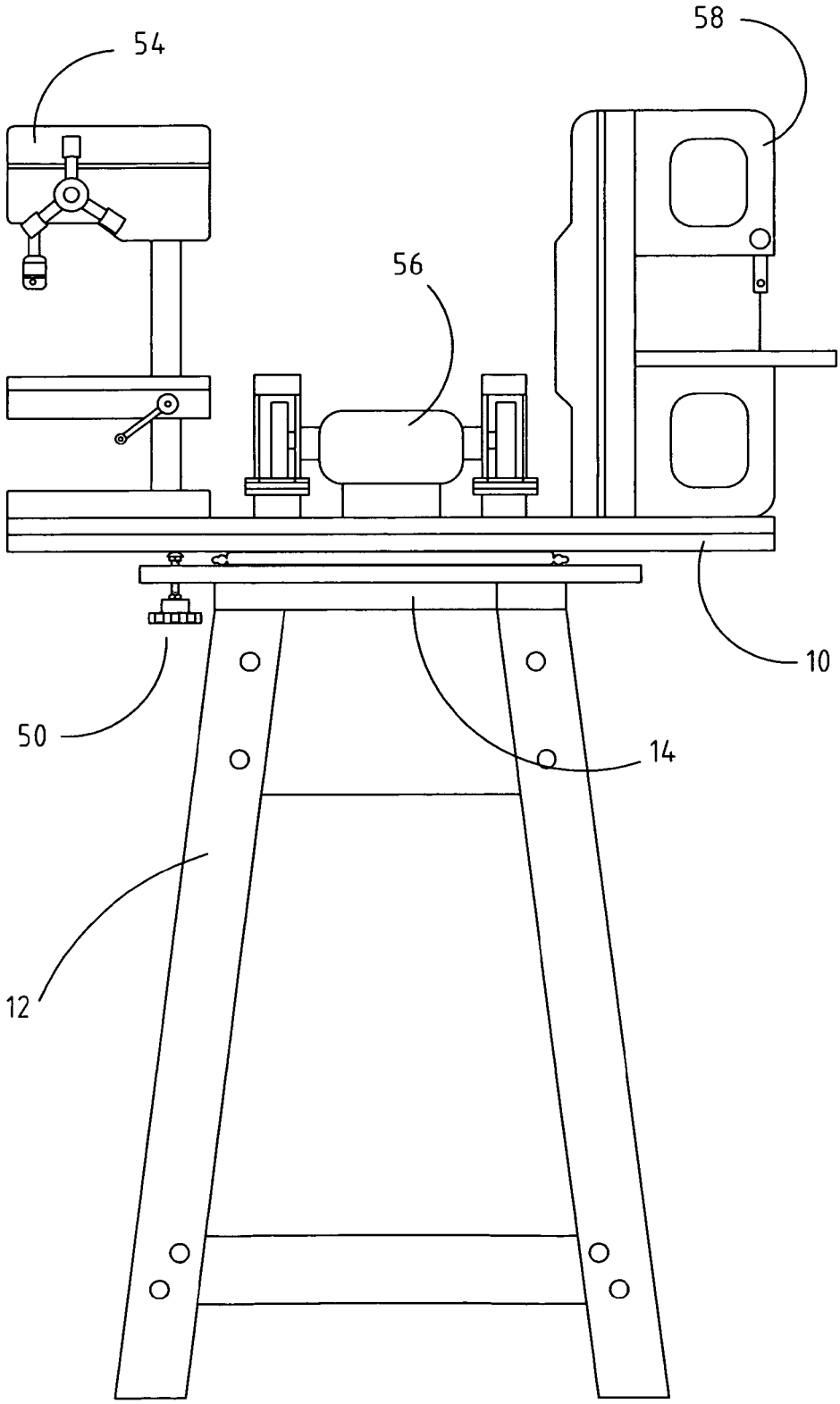
FIG. 1 is a front elevational view of the tool mounting structure of this invention mounted on a workbench and carrying a plurality of shop tools therein.

The first preferred embodiment of the tool mounting structure of this invention is generally indicated at 10 in FIGS. 1, 2, 3, and 5. The structure 10 is not floor mounted. In FIG. 1, it is shown as being mounted on a workbench 12 which has legs and a workbench top 14.

Figure 3:
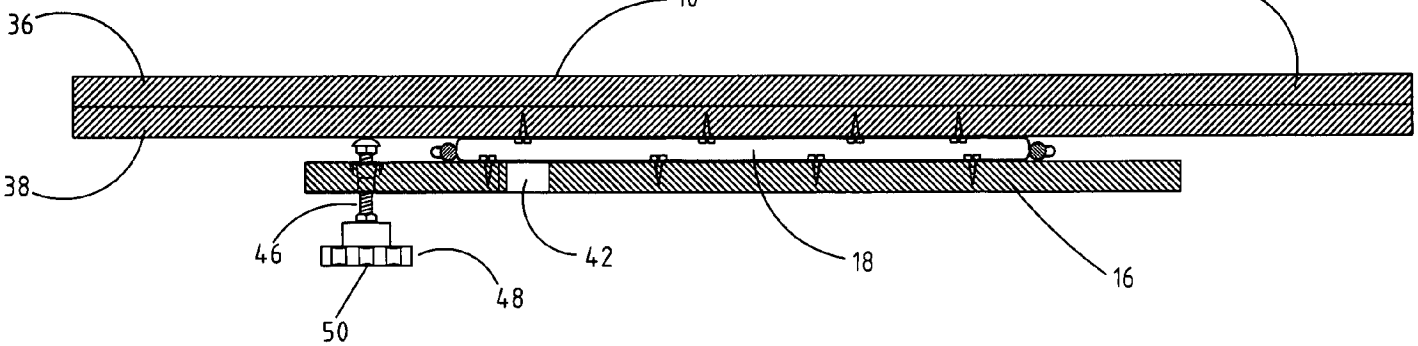
FIG. 3 is an enlarged section taken generally along line 3-3 of FIG. 2.
Figure 5:
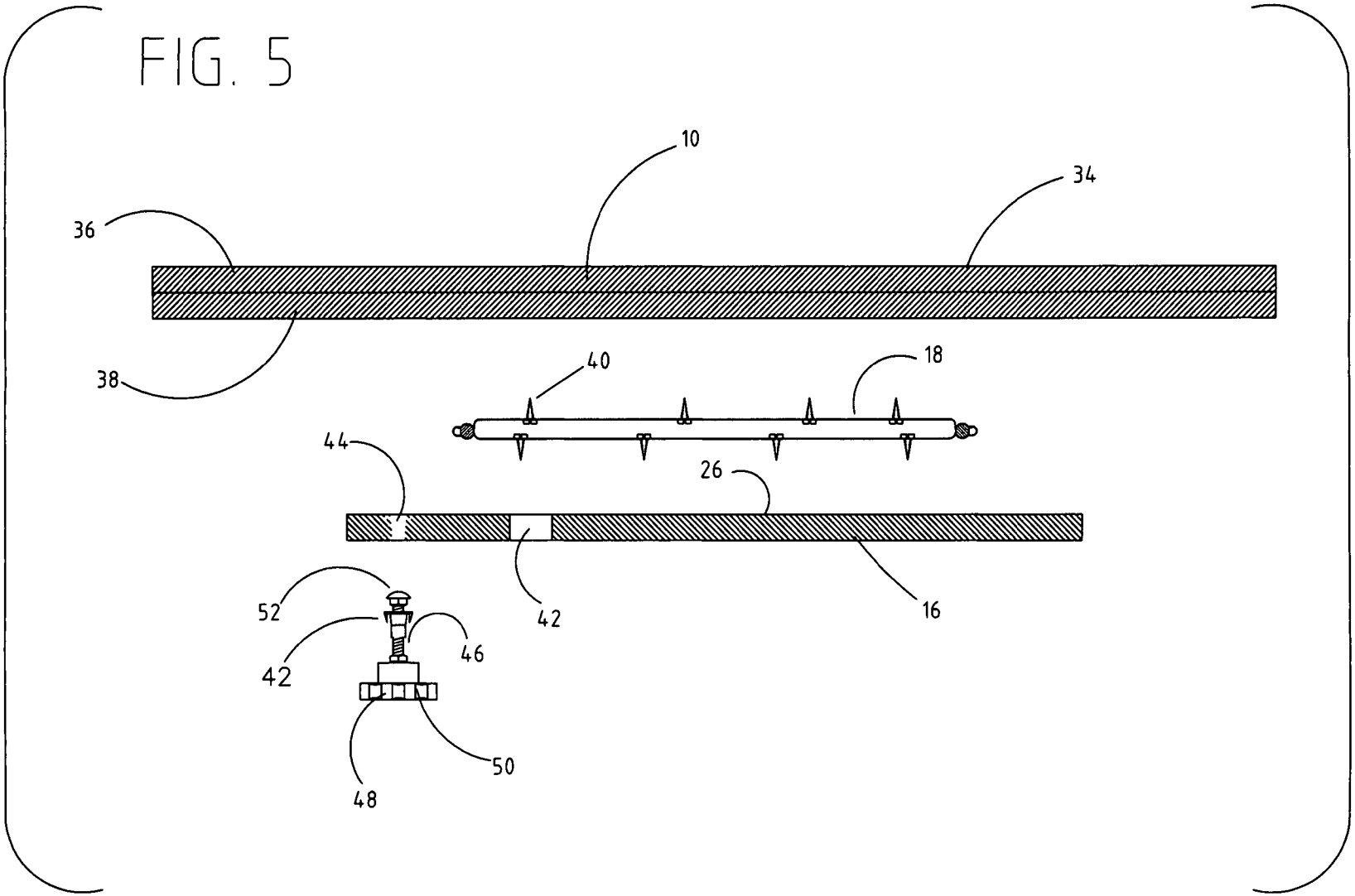
FIG. 5 is an exploded view of the tool mounting structure, showing the various parts thereof.

The tool mounting structure 10 is shown in more detail in FIGS. 3 and 5, which are sections through the center of the tool mounting structure. The tool mounting structure comprises a base plate 16 which is directly mountable on the workbench top 14, by any convenient attachment means, including through bolts. The base plate 16 may be round, rectangular, or square. A square configuration is most convenient. For most workshop projects, ¾-inch plywood is a suitable material for the base plate 16.

Figure 4:
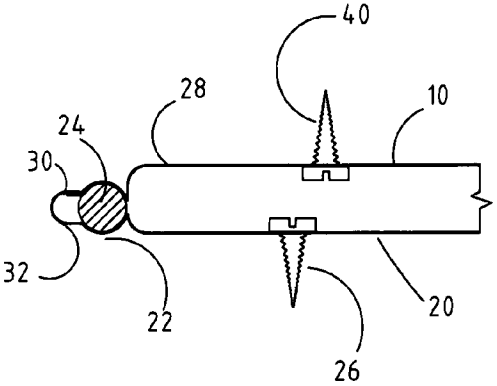
FIG. 4 is a further enlarged section taken through the edge of the bearing.

Attached to the base plate 16 is the lower half of thrust bearing 18. As seen in FIG. 4, the lower half 20 of the trust bearing 18 carries race 22 with a plurality of balls 24 therein. The lower bearing half 20 is secured to the base plate 16 by means of a plurality of screws, one of which is indicated at 26. Access to the screws 26 is provided by properly positioned openings in the upper bearing half 28. The upper bearing half 28 carries upper race 30. The lower and upper races retain the ball bearings therein and define the axis of rotation. The races are prevented from separating by means of retainer structure 32 which inter-engages and is formed on the outer edges of the upper and lower bearing halves. The vertical thrust ball bearing thus described is suitable for this use by reason of its rigidity and load bearing strength. Other types and styles of thrust bearing can be used, if they are of low enough height and are sufficiently strong and rigid.

Figure 2:
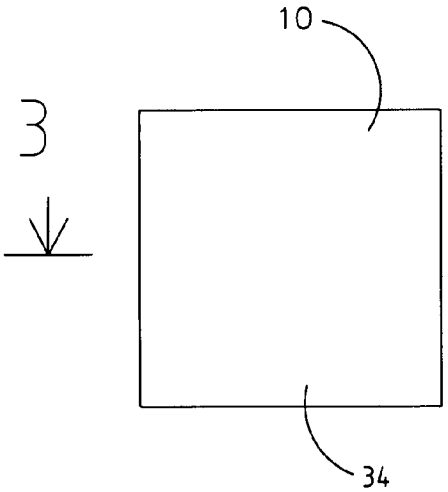
FIG. 2 is plan view of the first preferred embodiment of the tool mounting structure.

Top plate 34 needs to be sufficiently strong to support the tools which will be mounted thereon. For convenience and rigidity, the top plate is made out of first and second panels 36 and 38, both of which are preferably ¾-inch plywood. In FIGS. 2, 3, and 5, the panels are shown as having edges in alignment with each other. The top plate 34 is attached to the top of bearing 18 by means of screws 40, see FIG. 4. Access to install these screws is provided by access hole 42 in the base plate 16. At this point of assembly, the top plate is freely rotatable with respect to the base plate.

Under the circumstances of which this tool mounting structure is to be used, it is necessary that the top plate can be selectively locked in selected position. This is accomplished by installing a nut 42 in a locking hole 44 in the base plate 16, see FIG. 5. Bolt 46 is skirted downwardly though the nut 42 and has a knob 48 attached thereto. This assembly becomes a rotary position lock 50, because manual actuation of the knob raises the head 52 against the underside of top plate 34, as seen in FIG. 3. This locks the top plate in a selected rotary position. In this way, rotary table positioning is achieved and locked.

This completes the tool mounting structure. It is mounted on the top of a support structure such as table 12 by any convenient means, such as bolts securing the base plate against the top of the workbench 12, as seen in FIG. 1. Individual shop equipment can be secured to the top of the top plate in traditional manner such as by through bolts. FIG. 1 illustrates the attachment of a drill press 54, bench grinder 56, and band saw 58 on the top plate, each facing out on the top plate with respect to the rotational axis. When a particular shop tool is to be used, the rotary lock 50 is released, the top plate is rotated until the selected tool is brought into accessible position. Thereupon, the lock 50 is again secured and that selected tool is used. Another selected tool can be quickly brought into place by releasing the lock, rotating the top plate into selected position, and reapplication of the lock 50. Thus, space is saved and a selected tool can be quickly brought into position where it is accessible.

Figure 6:
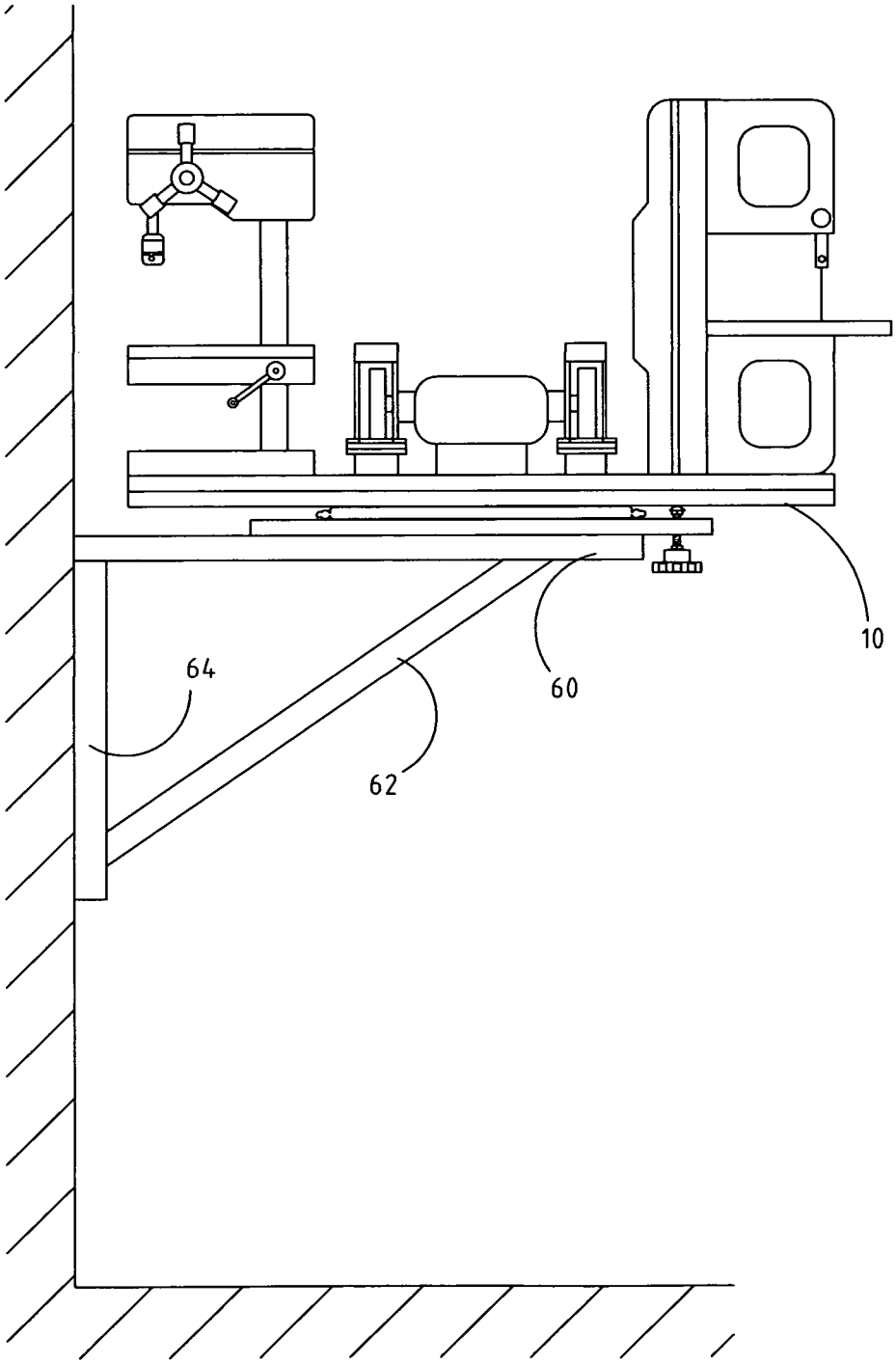
FIG. 6 is a side elevational view of the tool mounting structure, mounted on a wall mounted bracket and carrying shop tools thereon.

FIG. 6 illustrates that the tool mounting structure 10 can be mounted on a wall mounted shelf 60 to further conserve floor space. The wall mounted shelf 60 is conventionally supported by means of a knee 62 which attaches to wall mount 64.

Figure 7:
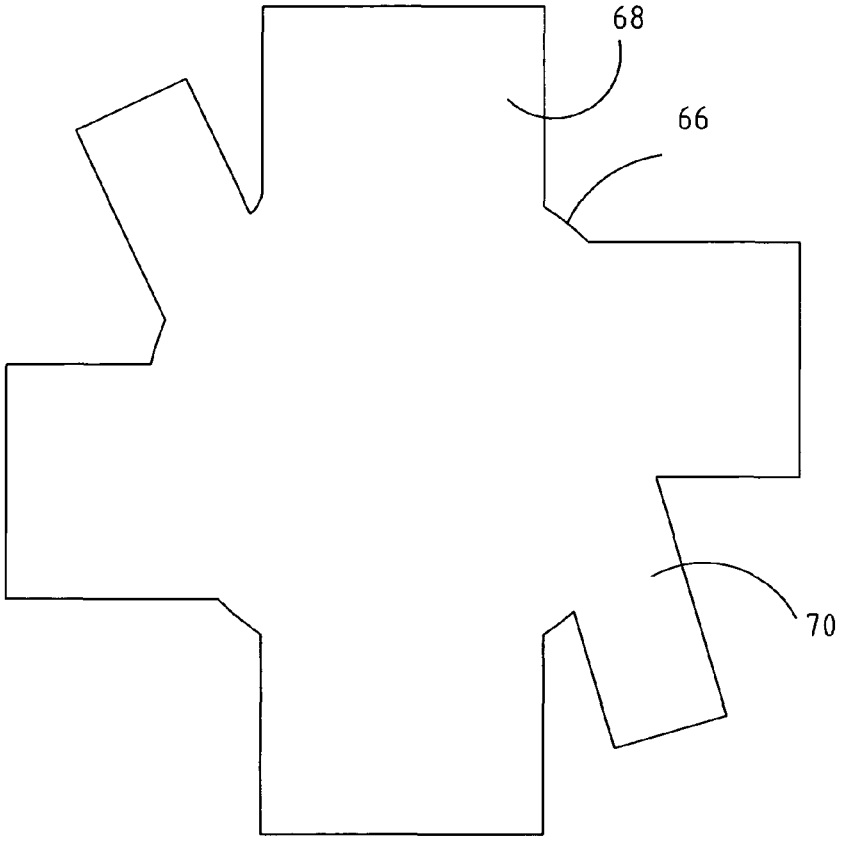
FIG. 7 is a plan view of the second preferred embodiment of the tool mounting structure of this invention.

FIG. 7 illustrates the plan view of the top plate 66, which instead of square or rectangular, is configured with arms upon which different shop tools can be secured. The central circular portion of top plate 66 has the bearing thereunder and various arms extend out and are shaped for shop tools. The larger arms, such as arm 68, are sized to carry bench drill presses or bench band saws, while the smaller arms, such as arm 70 are sized to carry belt sanders or other devices of more narrow configuration.

Figure 8:
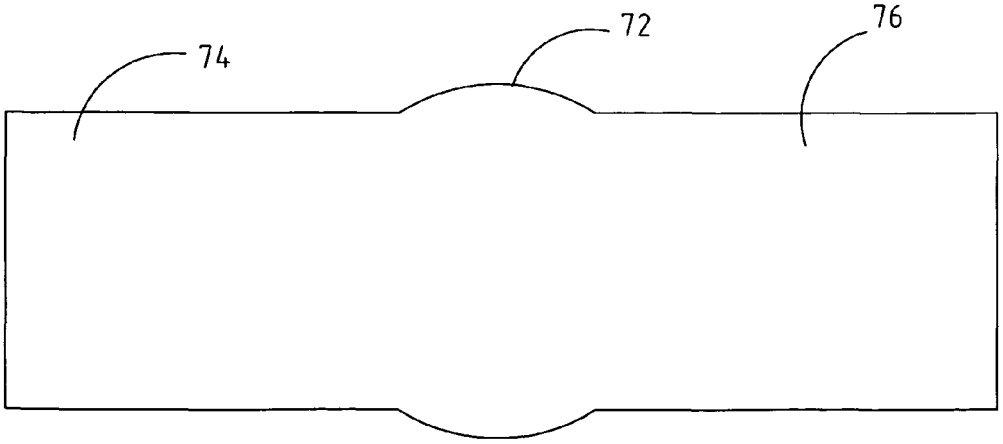
FIG. 8 is a plan view of the third preferred embodiment of the tool mounting structure of this invention.

FIG. 8 is a plan view of another preferred embodiment of the configuration of the top plate. In this case, top plate 72 has a circular central portion which overlies the bearing and has two larger arms 74 and 76 extending therefrom to carry shop tools of larger configuration.

This invention has been described in its preferred embodiments. It is clear that it is susceptible to numerous modifications and embodiments within the ability of those skilled in the art. Accordingly, the scope of this invention is defined by the scope of the following claims.

The invention claimed is:

1. A tool mounting structure comprising:

a base plate suitable for mounting on a workbench;

a bearing mounted on said base plate, said bearing having a rotational axis;

a top plate mounted on said bearing, said top plate having a substantially planar top surface;

a lower race secured to said base plate and an upper race secured to said top plate, bearing balls between said races so that said top plate rotates with respect to said bottom plate on a rotational axis defined by said bearing balls rolling in said races, a locking structure engaged between said base plate and said top plate to releasably lock said top plate in selected rotary position with respect to said base plate to maintain said top plate in the rotary position wherein the selected shop tool is accessible, said locking structure comprising a threaded shaft threadedly engaged in one of said plates, said threaded shaft having a locking end thereon so that when said threaded shaft is rotated in its plate, said locking end extends to engage against the other said plate to inhibit rotation of said plates with respect to each other;

said substantially planar top surface being substantially at a right angle with respect to said axis so that when said axis is vertical, said substantially planar top surface of said top plate is substantially horizontal, said top surface of said top plate being configured for the mounting thereon of a plurality of shop tools so that any one of the shop tools can be selected for use and said top plate rotated to bring the selected shop tool to accessible position.

2. The tool mounting structure of claim 1 wherein said top plate is made of two layers of laminated wood attached to each other.

3. The tool mounting structure of claim 1 wherein said top plate is rectangular so that it has four edges adjacent which a shop tool can be secured.

4. The tool mounting structure of claim 1 wherein said top plate has a plurality of arms extending substantially radially outward from said axis and each of said arms is sized to receive a selected shop tool.

* * * * *